US009161136B2

(12) United States Patent
McArthur et al.

(10) Patent No.: US 9,161,136 B2
(45) Date of Patent: Oct. 13, 2015

(54) TELECOMMUNICATIONS METHODS AND SYSTEMS PROVIDING USER SPECIFIC AUDIO OPTIMIZATION

(71) Applicant: Avaya Inc., Basking Ridge, NJ (US)

(72) Inventors: Chris McArthur, Belleville (CA); Paul Haig, Carrying Place (CA); John C. Lynch, Belleville (CA); Paul Roller Michaelis, Louisville, CO (US)

(73) Assignee: Avaya Inc., Basking Ridge, NJ (US)

( * ) Notice: Subject to any disclaimer, the term of this patent is extended or adjusted under 35 U.S.C. 154(b) by 325 days.

(21) Appl. No.: 13/744,247

(22) Filed: Jan. 17, 2013

(65) Prior Publication Data

US 2014/0200884 A1 Jul. 17, 2014

(51) Int. Cl.
*H04R 25/00* (2006.01)

(52) U.S. Cl.
CPC ..... *H04R 25/00* (2013.01); *H04R 2205/041* (2013.01)

(58) Field of Classification Search
CPC ..... H04R 25/00
USPC ..... 704/206
See application file for complete search history.

(56) References Cited

U.S. PATENT DOCUMENTS

| | | | | |
|---|---|---|---|---|
| 5,737,719 | A * | 4/1998 | Terry | 704/224 |
| 6,026,361 | A * | 2/2000 | Hura | 704/270 |
| 6,061,431 | A | 5/2000 | Knappe et al. | |
| 6,889,186 | B1 | 5/2005 | Michaelis | |
| 7,483,831 | B2 * | 1/2009 | Rankovic | 704/225 |
| 7,831,025 | B1 * | 11/2010 | Francis et al. | 379/1.01 |
| 8,195,453 | B2 * | 6/2012 | Cornell et al. | 704/226 |
| 8,433,568 | B2 * | 4/2013 | Krause et al. | 704/237 |
| 8,706,919 | B1 * | 4/2014 | Eisner | 710/8 |
| 8,774,247 | B2 * | 7/2014 | Sukegawa et al. | 372/57 |
| 2006/0045281 | A1 * | 3/2006 | Korneluk et al. | 381/60 |
| 2008/0254753 | A1 | 10/2008 | Steenstra et al. | |
| 2010/0098262 | A1 * | 4/2010 | Frohlich | 381/60 |
| 2010/0329490 | A1 * | 12/2010 | Van Schijndel et al. | 381/314 |
| 2012/0051569 | A1 * | 3/2012 | Blamey et al. | 381/314 |

OTHER PUBLICATIONS

Non-published U.S. Appl. No. 13/569,946, (Avaya IDR 512085), Method and Apparatus for Automatic Communications System Intelligibility Testing and Optimization, Michaelis et al. (on file, not submitted with this form).

* cited by examiner

*Primary Examiner* — Susan McFadden

(74) *Attorney, Agent, or Firm* — Avaya Inc.

(57) ABSTRACT

Systems and methods for applying user specific acoustic adjustment parameters are provided. The intelligibility of speech for a particular user is determined and a set of acoustic adjustment parameters is determined. The set or template of acoustic adjustment parameters for the user is placed in central store, for example provided as or in association with a server. The template can be obtained from the server for application in connection with a communication involving the user by providing an identification of the template.

20 Claims, 3 Drawing Sheets

TELECOMMUNICATIONS METHODS AND SYSTEMS PROVIDING USER SPECIFIC AUDIO OPTIMIZATION

CROSS-REFERENCE TO RELATED APPLICATIONS

This application is related to U.S. patent application Ser. No. 13/569,946, filed Aug. 8, 2012, the entire disclosure of which is hereby incorporated herein by reference.

FIELD

Methods and apparatuses for the application of user-specific acoustic property parameters in communication systems are provided.

BACKGROUND

The hearing loss experienced by people who are hard of hearing is rarely uniform across the entire audio spectrum. For example, a person's hearing may be down by only 5 dB at 500 Hz, and down by 20 dB at 2,000 Hz. For users with this type of hearing loss, it can be helpful to provide a compensating amount of amplification at frequencies where the user is known to have a specific amount of hearing loss. Using the above example, this compensation could be a 5 dB boost at 500 Hz and a 20 dB boost at 2,000 Hz. An underlying assumption of this approach is that intelligibility, i.e., the ability for a listener to discriminate between two essentially similar sounds, is highly correlated with the ability to perceive all frequencies in the acoustic spectrum at the correct amplitude.

Although there are electronic audio devices that allow users to adjust the spectral characteristics for themselves, typically via what are commonly referred to as "tone controls" or "graphic equalizers," a problem with this approach when applied to telecommunication systems is that users tend to adjust the characteristics to maximize the aesthetic quality of the voice rather than the intelligibility. (The inability of hard of hearing users to self-adjust audio systems optimally is a reason why audiologists, and not the individual users, make the spectral adjustments on users' hearing aids.) But perhaps the most important reason why self-adjustment of the spectral characteristics may not yield optimal speech intelligibility for hard of hearing users is that certain types of audio degradation that are common in telecommunication systems can affect these users differently from users with normal hearing, and are best mitigated through techniques that do not rely exclusively on simple spectral compensation. Examples include the distortions introduced by audio compression (e.g., GSM or G.729), packet loss, ambient noise, transducer quality, and poor signal to noise ratio. In this context, it is important to note that the optimal mitigation strategy will differ among individuals depending on the nature of the individual's hearing loss.

A user can have an assessment performed by an audiologist to obtain an acoustic compensation "prescription" that can be applied to increase the intelligibility of communications using telephones or other electronic audio devices. In practice however, it remains difficult for the user to access and apply their particular set of audiologist determined acoustic adjustments to electronic communications. This problem is even more apparent where the user desires the ability to apply their acoustic adjustments to a wide range of electronic audio devices or communication devices and/or to communication devices on an ad hoc basis.

SUMMARY

Systems and methods for applying user-specific acoustic adjustment parameters for improving the intelligibility of speech delivered to a user through a communication system are provided. More particularly, user-specific acoustic adjustment parameters are stored as templates in a central location. A user can access a template of acoustic adjustment parameters applicable to that user for application to a communication session by connection to the central location. Moreover, the template can be applied on behalf of the user for use in connection with different user devices or communication endpoints. Accordingly, the application of user-specific acoustic adjustment parameters to increase the intelligibility of speech delivered to the user through a user device is facilitated.

Systems in accordance with the present disclosure include a server and at least one user endpoint. The server includes or has access to data storage that contains one or more sets of acoustic adjustment parameters. Where a plurality of sets of acoustic adjustment parameters are stored, different templates can be stored for different users and/or different communication channel characteristics for a single user. A user can access a template by providing an identification of the user and/or the desired template to the server. The server can then apply the acoustic adjustment parameters to a communication session on behalf of the user, or can deliver the acoustic adjustment parameters to another server or to a user communication device for application in connection with the communication session. A user can identify and/or receive a desired template at a communication device over an out of band channel. The server can be accessible by a user through a public network, such as but not limited to the Internet. As another example, the server can part of an enterprise network to which a communication device is attached.

Methods in accordance with embodiments of the present disclosure include providing an identification of a user template comprising acoustic adjustment parameters to a server that includes or that has access to data storage containing the user template. The identification can be provided by a user, for example by providing an address, such as a uniform resource locator (URL), or other information uniquely identifying the user's template. As another example, the appropriate template can be determined through presence or other information identifying the user of a communication device that is provided to the server, for example in connection with establishing a communication session. After the template has been identified, the acoustic adjustment parameters included in the template can be applied to a communication session, increasing the intelligibility of speech for the user. Application of the acoustic adjustment parameters can be accomplished by delivering those parameters to the communication device or to a communication server for implementation by the communication device or communication server. Alternatively, application of the acoustic adjustment parameters can be accomplished by the server providing the template.

Additional features and advantages of embodiments of the present disclosure will become more readily apparent from the following description, particularly when taken together with the accompanying drawings.

DETAILED DESCRIPTION

Figure 1:
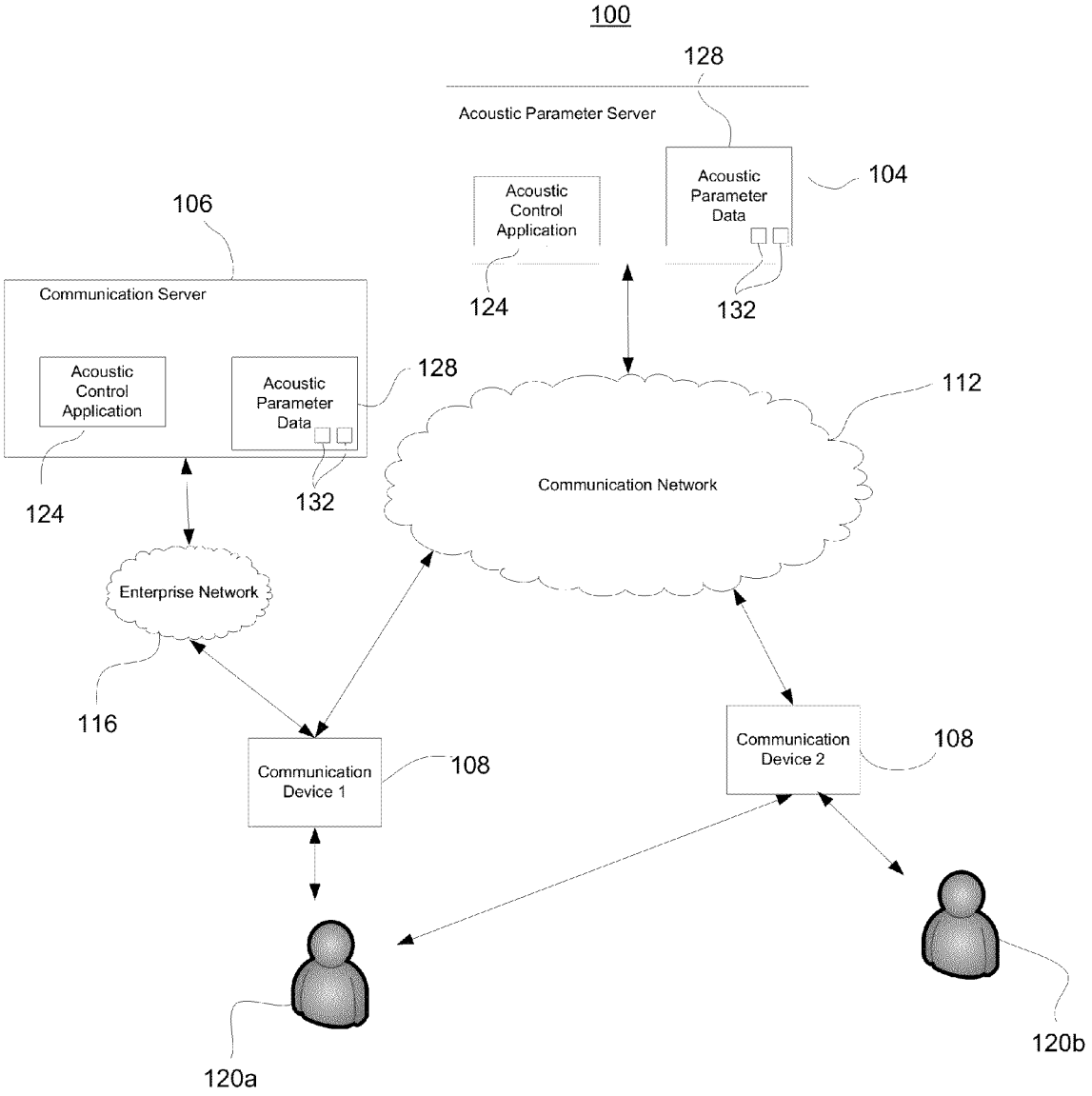
FIG. 1 illustrates components of a communication system in accordance with embodiments of the present disclosure.

FIG. 1 depicts a communication system 100 in accordance with embodiments of the present disclosure. In general, the system 100 can include an acoustic parameter server 104 and/or a communication server 106. The server or servers 104, 106 are interconnected to one or more communication devices or endpoints 108 via a communication network 112 and/or an enterprise network 116. Each communication device 108 may be associated with a user 120.

One or both of an acoustic parameter server 104 and a communication server 106 can be included in the system 100. Because the acoustic parameter server 104 and the communication server 106 can both perform various operations in support of the disclosed communication system 100, and because they both can be implemented using the same or similar hardware, the following disclosure will apply to both types of servers 104, 106, unless indicated otherwise. The server 104, 106 may be implemented as a general purpose computer or server device, and may provide communication, data storage and/or web services to client devices, including but not limited to communication devices 108. The server 104, 106 can include an acoustic control application 124 that is operable to provide an interface with a user 120, for example through a user or communication device 108, to allow the server 104, 106 to receive, store, apply and/or provide acoustic parameter data 128. The server 104, 106 can also include acoustic parameter data 128 that is stored on the server 104, 106. Alternatively or in addition, acoustic parameter data 128 can be stored in a separate server or data storage device.

A communication endpoint or device 108 may comprise a desktop telephone, cellular telephone, smart phone, soft phone, two-way radio, or other device capable of supporting voice communications or the delivery of speech to the user 120. In addition, different communication endpoints 108 can be associated with different networks or audio encoding algorithms. In general, each communication endpoint 108 is associated with at least one user 120. In addition, one user 120 may be associated with multiple communication devices 108. For example, one user 120 may be associated with a first communication device 108 comprising a desk phone, and a second communication device 108 comprising a cellular telephone. As can be appreciated by one of skill in the art, different communication devices can have different audio playback characteristics and/or can operate with different networks 112 and different audio encoding algorithms, which affect the quality and characteristics of speech or audio signals.

Figure 2:
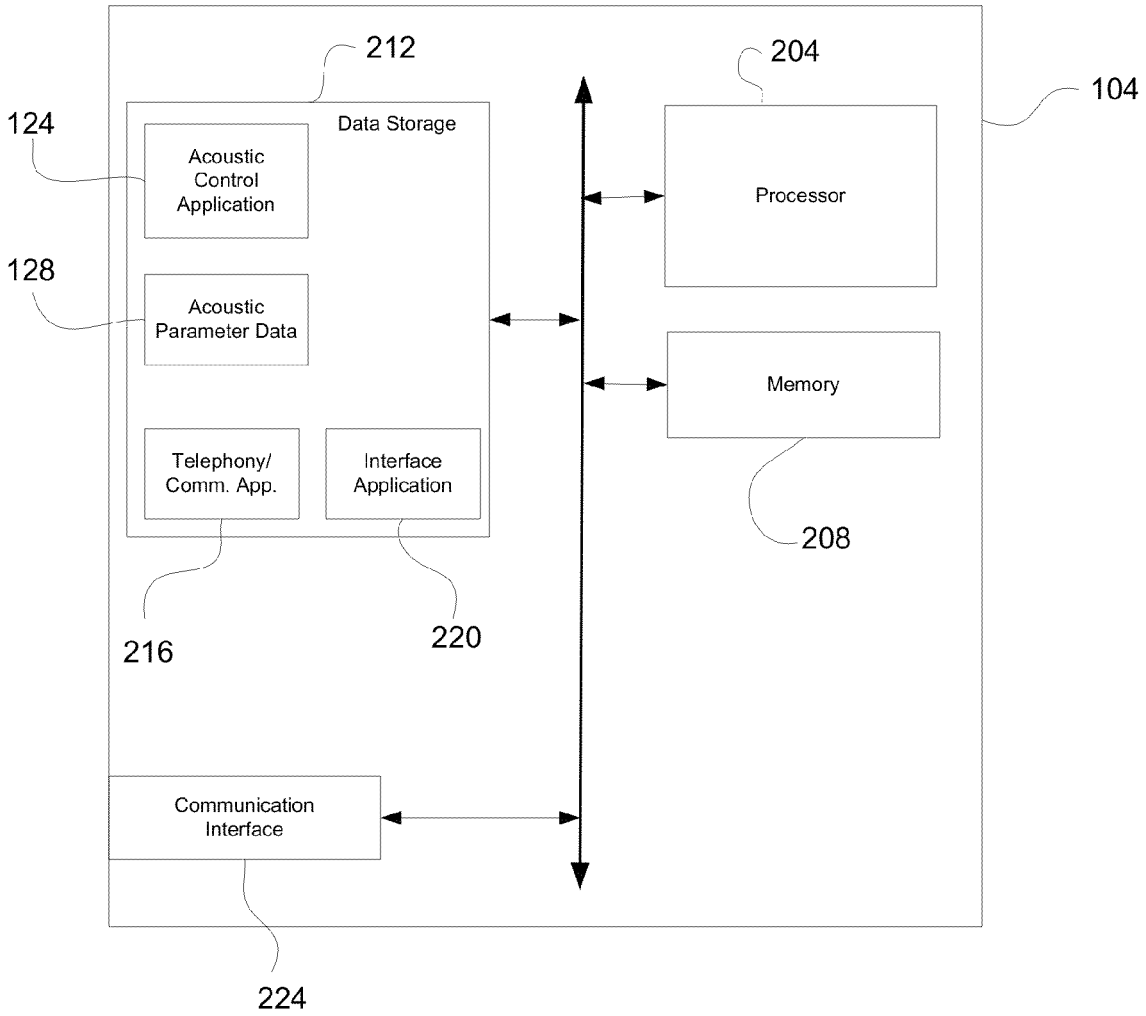
FIG. 2 depicts components of a server in accordance with embodiments of the present disclosure.

With reference now to FIG. 2, components of a server 104, 106 in accordance with embodiments of the present disclosure are depicted. In general, the server 104, 106 includes a processor 204. The processor 204 may comprise a general purpose programmable processor or controller for executing application programming or instructions. As a further example, the processor 204 may comprise a specially configured application specific integrated circuit (ASIC) or other integrated circuit, a digital signal processor, a programmable logic device, or the like. The processor 204 generally functions to run programming code or instructions, for example in the form of applications, implementing various functions of the communication server 104. Although shown as a single processor 204, the processor 204 may comprise multiple devices.

A server 104, 106 can also include memory 208 for use in connection with the execution of application programming or instructions by the processor 204, and for the temporary or long term storage of program instructions and/or data. As an example, the memory 208 may comprise RAM, SDRAM, or other solid state memory. Alternatively or in addition, data storage 212 can be provided as part of a server 104, 106. In accordance with embodiments of the present invention, data storage 212 can contain programming code or instructions implementing various of the applications or functions executed by the communication server 104. Like the memory 208, the data storage 212 may comprise a solid state memory device or devices. Alternatively or in addition, the data storage 212 may comprise a hard disk drive or other random access memory.

In accordance with embodiments of the present invention, the data storage 212 can include various applications and data. For example, the data storage 212 can include the acoustic control application 124 and the acoustic parameter data 128. Moreover, the acoustic parameter data 128 can comprise one or more templates 132 of acoustic adjustment parameters for one or more users 120. As a further example, the data storage 212 can include a telephony/communication application 216. The telephony/communication application 216 may provide support for voice and/or video telephony communications between one or more communication devices 108, and/or between a communication device 108 and a server 104, 106. Such communications may be established using communication channels established over a network 112 and/or 116. As can be appreciated by one of skill in the art after consideration of the present disclosure, various mechanisms and/or protocols can be used to support voice or video communication sessions, including but not limited to the Public Switched Telephone Network (PSTN), Voice over Internet Protocol (VoIP), and Session Initiation Protocol (SIP). As yet another example, the data storage 212 can include an interface application 220. The interface application 220 can provide a control interface to a user 120 and/or an administrator for providing acoustic parameter data 128, modifying acoustic parameter data 128, and/or providing user control over the application of acoustic parameter data 128. As an example, the interface application 220 may comprise a web server or interface that supports communications between the server 104, 106 and a communication device 108 over an out of band channel. As can be appreciated by one of skill in the art after consideration of the present disclosure, an out of band channel may comprise a communication channel that is different than a communication channel used to support a voice or video communication session.

A communication server 104 can additionally include one or more communication interfaces 224. For instance, a communication interface 224 can be provided to operably interconnect the server 104, 106 to a communication network 112, an enterprise network 116, and/or a communication device 108. As examples, a communication interface 224 can included but is not limited to a network interface card, an Ethernet interface, a public switched telephony (PSTN) interface, and a cellular telephony network interface.

Figure 3:
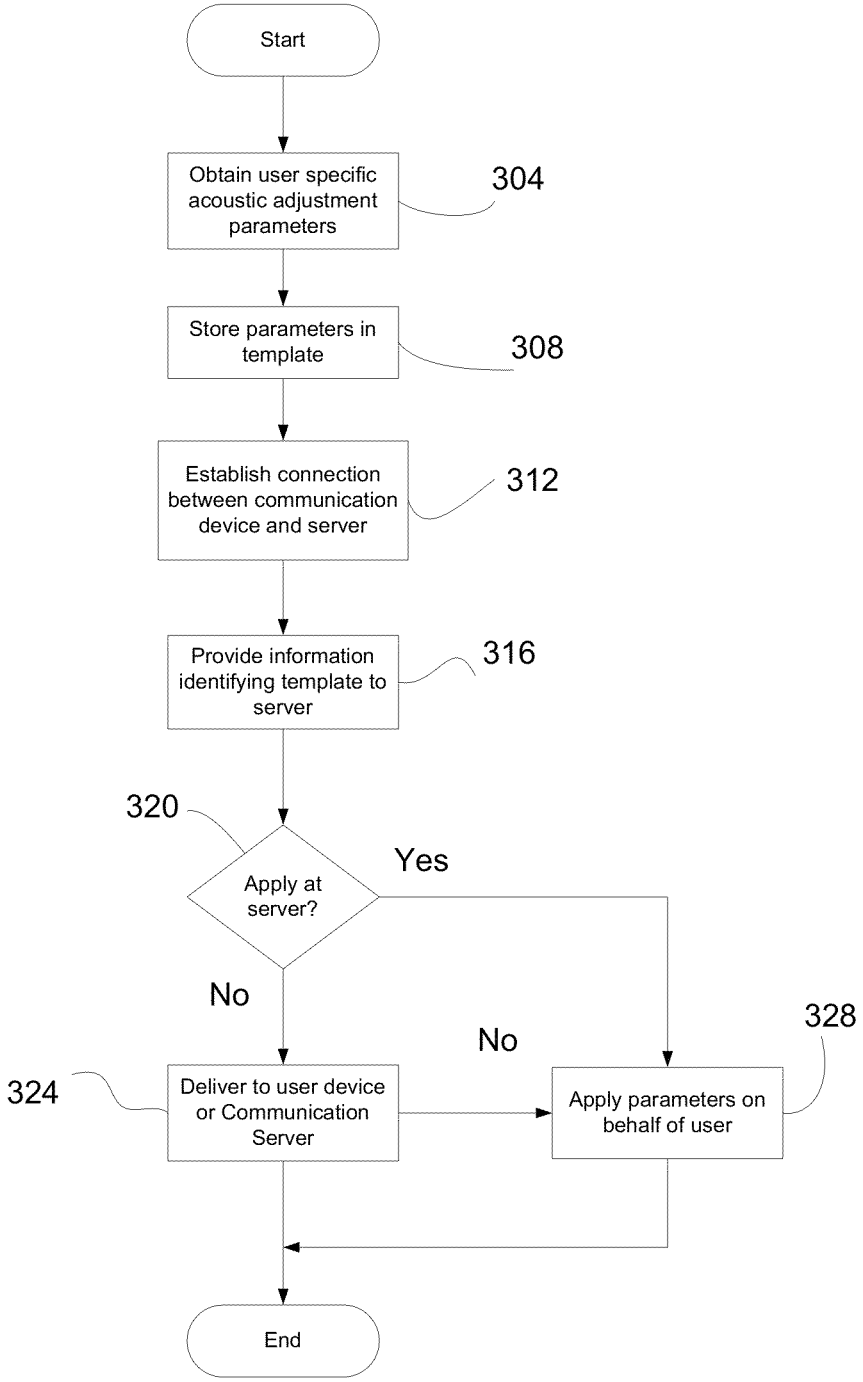
FIG. 3 is a flowchart depicting aspects of a method in accordance with embodiments of the present disclosure.

FIG. 3 is a flowchart illustrating aspects of the operation of a system 100 in accordance with embodiments of the disclosed invention. Initially, user specific acoustic adjustment parameters are obtained (step 304). The user specific acoustic adjustment parameters may comprise a set of acoustic adjustment parameters that have been determined enhance the reproduction of audio signals, and in particular speech, on behalf of a specific user 120. More particularly, the adjustments applied for a particular user 120 can be determined with the goal or result of increasing the intelligibility of speech that is output to that user by a communication device 108. The acoustic adjustment parameters for the user 120 can be determined by an audiologist or other professional. For example, the acoustic adjustment parameters can be determined by an audiologist through the administration of an intelligibility test. Alternatively, the acoustic adjustment parameters for a user can be determined through automated means, or by the user 120. A single user 120 can have more than one set of acoustic adjustment parameters. For example, different sets of acoustic adjustment parameters can be established for application with the user 120 in different environments, using different endpoints 108, or using different networks 112, 116. More particularly, different sets of acoustic adjustment parameters for a single user 120 can be established to account for factors that could affect the type of adjustments that might be appropriate, such as the audio codec, ambient noise, signal-to-noise ratio, type of phone, and the like.

At step 308, the obtained or determined acoustic adjustment parameters are stored in a template. For example, a set of acoustic adjustment parameters may be provided to the server 104, 106 using a data connection established over a network 112, 116 that extends between a communication device 108 and the interface application 220 on the server 104, 106. As another example, the acoustic adjustment parameters for a user 120 can be provided to the server 104, 106 using a communication device 108 associated with a person or entity who performed intelligibility testing for the user 120. Once a set of acoustic adjustment parameters have been received at the server 104, 106, the acoustic control application 124 can assign an identifier to the template 132 of acoustic adjustment parameters to identify it as being associated with a particular user 120, and store the template 132 in data storage 212 as acoustic parameter data 128. For example, a template 132 of acoustic adjustment parameters can be prepared and stored as acoustic parameter data 128 in data storage 212 on or associated with a server 104, 106. A different template (or set of templates) 132 may be stored for each user 120 of the system 100 for whom acoustic adjustment parameters have been obtained. A user 120 may also have multiple templates, for example where different sets of acoustic adjustment parameters are established for application with different communication devices 108, different networks 112, 116, different ambient environments, etc. A unique alpha-numeric identifier can be associated with each different template. More particularly, each template 132 can be uniquely identified as being associated with a particular user 120. The association of an identifier with a template 132 can be performed in association with the acoustic control application 124 and/or the interface application 220 of a server 104, 106.

At step 312, a connection between a communication device 108 and a server 104, 106 providing acoustic adjustment services is established. The connection to the interface application 220 can be established by entering a URL, by simply starting a specially provided application or app, or by dialing a telephone number. Moreover, the connection to the sever 104, 106 can be established prior to, as part of, or after the initiation of a communication session (e.g., a voice telephony session) involving the communication device 108. For example, an in-band connection (e.g., a call) or an out-of-band connection (e.g., a web session) can be established between the communication device 108 and the server 104, 106 prior to placing a call. Alternatively, a server 104, 106 can monitor calls including a communication device 108 and/or a user 120 and can establish a connection when such a call is in progress, automatically or in response to a user entered code (e.g., a DTMF code). As yet another example, an in-band signal (such as a key code) or an out-of-band signal can be sent from the user 120 to the server 104, 106 after a call is in progress.

Information that can be used by the acoustic control application to identify an appropriate template 132 or set of acoustic adjustment parameters can then be provided (step 316). The information identifying the template 132 can be in the form of information identifying the user 120 for whom the acoustic adjustment parameters will be applied. Accordingly, the information identifying the template 132 can be in the form of information identifying the user 120. Examples of such information include, but are not limited to, the name of the user, an identification number or code for the user, an identification number or code for the desired template, a uniform resource locator (URL), a telephone number, caller identification information, or the like. In addition, the information identifying the user can be provided through information entered directly by the user, indirectly by the user, or through automated processes. For example, the user 120 can establish an out of band connection with the server 104, 106, over which a request for application of a template 132 and information identifying the template 132 can be delivered. In such a scenario, the user 120 can provide information to the acoustic control application 124 using a web browser or an application or app specifically provided for such communications that is running on a user device, such as but not limited to a communication device 108, via an interface application 220, such as but not limited to a web server application, on the server 104, 106. The identifying information can then provided from information stored locally on the communication device 108, from information entered in a field of a user interface presented to the user 120, or through a dual tone multiple frequency (DTMF) sequence entered by the user 120. As another example, the information identifying the template 132 can be provided using presence-based techniques, where information identifying the location of the user 120 is correlated to a communication device 108. As yet another example, the server 104, 106 can monitor communications from or involving certain communication devices 108, and a template 132 can be identified based on the particular communication device 108 in use.

At step 320, a determination can be made as to whether the identified acoustic adjustment parameters are to be applied at or by the server 104, 106. If the acoustic adjustment parameters are not to be applied at the server 104, 106, the identified template 132 or set of acoustic adjustment parameters can be delivered to the communication endpoint 108 associated with the user 120, or to a communication server 106 that is different than the server 104, 106 providing the acoustic adjustment parameters (step 324). After delivering the acoustic adjustment parameters to the communication endpoint 108 or communication server 106, or after determining that they should be applied by the server 102, 104, the acoustic adjustment parameters are applied on behalf of the user (step 328). The application of adjusted speech signal parameters can include modifying the speech signal provided as part of an audio communication including the communication endpoint 108 of the user 120 for whom adjusted speech signal parameters are to be applied. The result is that the intelligibility of the speech that is output to the user 120 is improved for that user 120, as compared to output that is not specially adjusted according to the acoustic adjustment parameters for the user 120. The acoustic adjustment parameters can include spectral shaping, in which different frequencies of an audio frequency are amplified or attenuated in order to improve the intelligibility of the speech signal to the user 120. As a further example, the adjusted speech signal parameters can include adjustments to the length of data frames containing the audio data comprising the speech signal. For example, by lengthening data frames containing plosive sounds, the intelligibility of such sounds can be improved. Another technique for improving the intelligibility of speech, which is described in U.S. Pat. No. 6,889,186 to Michaelis, identifies portions of the speech signal that includes sounds that typically present intelligibility problems and modifies those portions in an appropriate manner. For example, the amplitude of frames determined to include unvoiced plosive sounds may be boosted. In addition, the amplitude of frames preceding such unvoiced plosive sounds can be reduced to better accentuate the plosive.

When the acoustic adjustment parameters are to be applied by a server 104, 106, at least that portion of a communication channel comprising an audio signal that is to be output to the user 120 is passed to the server 104, 106 prior to delivery to the user, and the electronic signal that is delivered to the communication endpoint can be altered according to the acoustic adjustment parameters. Alternatively, where the acoustic adjustment parameters are applied by the communication device 108, the communication device 108 can adjust parameters of the audible output provided to the user 120 by the communication device 108. After applying adjusted parameters, or after determining that no adjusted parameters are available, the process can end.

In an example scenario, a user 120 may work with an audiologist to develop one or more sets of acoustic adjustment parameters that can be applied to improve the intelligibility of audible output, and in particular speech, for the user 120 in connection with audible signals output by a communication device 108. For example, the audiologist may administer one or more know intelligibility tests, such as a diagnostic rhyme test (DRT) or a modified rhyme test (MRT) for the user to determine what adjustments to acoustic output parameters can be made to improve intelligibility for the user 120. The results of the test can be stored as a template, identified with the user 120, that includes acoustic adjustment parameters in a central store provided as part of or in connection with a server 104, 106. The step of storing the template 132 can be performed by the user 120 or an administrator through an Internet or other data network connection between the server 104, 106 and a communication device 108 or other device that supports such connectivity. For instance, the user 120 can use a web browser or an app to connect to the server 104, 106 to enter modifications to a base or default template 132 of acoustic adjustment parameters, or to upload a file comprising the template 132 to the server 104, 106.

Continuing the example scenario, a user 120 can have the template 132 applied to any communication that includes the user 120. For example, the template 132 can be applied to any voice communication (e.g., a telephone call) that is recognized by the server 104, 106 as involving a communication device 108 associated with the user 120. Such recognition can be enabled through caller ID information associated with the communication device 108 that is received at the server 104, 106 where the server is involved in providing features or other support to the voice communication. Presence information for the user 120 that is made available to the server 104, 106 can also be used as an indicator that a template 132 associated with the user 120 should be applied. A user can also request the template 132 from the server 104, 106 for application to a communication, for example by dialing into the server 104, 106, or by interfacing with the server 104, 106 through an out of band channel. For instance, a user 120 can use a browser equipped communication device 108 to connect to the server 104, 106, identify the user's 120 template 132 of acoustic adjustment parameters, and request application of those adjusted parameters by the server 104, 106 holding them, delivery of the template 132 to another server (e.g., a communication server 106 that doesn't already have a copy of the template) for application by that other server 104, 106, or delivery of the template 132 to the communication device 108 for application by that communication device 108.

Embodiments of the present disclosure allow a user 120 to access acoustic adjustment parameters determined to improve the intelligibility of speech for that user 120 from a central server 104, 106. Moreover, different sets of acoustic adjustment parameters can be established for a single user 120, and selectively applied according to the telecommunications equipment (e.g. the communication device 108, network 112, 116, codec, etc.) being used, the ambient environment (e.g. in an office, in a public space, out of doors, in a moving vehicle, etc.) in which the user 120 is located, or other characteristics of a particular communication session. Accordingly, the application of acoustic adjustment parameters can depend on the communication device 108 and/or communication network 112, 116 involved in a communication session with the user 120. For example, a user 120 may have a set of acoustic adjustment parameters that are applied when the user 120 is involved in a communication session that uses a cellular telephone connected via a Bluetooth connection to a microphone and speakers provided as part of an automobile. As yet another example, a different set of acoustic adjustment parameters can be determined with respect to a particular communication device 108 when that communication device is being used in the home, another set of acoustic adjustment parameters can be developed for application with that same communication device 108 when the user 120 is on a city street, and yet another set of acoustic adjustment parameters can be established for when the user 120 is in an automobile. As can be appreciated by one of skill in the art, the conditions that affect intelligibility can change mid-call. Embodiments of the present disclosure allow the set of acoustic adjustment parameters that are applied to be changed during a call. For example, when the user moves from a quiet to a noisy environment or vice versa, changes in packet loss rates due to network congestion, or any other change that can be detected by the communication server 104, 106 or endpoint 108 can result in an automatic change in the applied speech signal adjustment parameters by identifying an alternate set of acoustic adjustment parameters for application. A change in the acoustic adjustment parameters that are applied can be made through automatic detection by the system 100 of changed conditions, or in response to instructions or commands entered by a user 120. Accordingly, continuous optimization of the audible output provided to the user 120 is possible. In addition, different acoustic adjustment parameters can be applied for different users 120 at different communication endpoints 108 participating in a communication session simultaneously.

In accordance with further embodiments of the present disclosure, acoustic adjustment parameters for user can be included in a master template. The adjustments set indicated by the master template 132 can then be modified for particular applications or instances, either by the user or by the system 100 in response to information about the particular instance that would affect the reproduction of the audible signal at the communication device 108 of the user 120.

The foregoing discussion of the invention has been presented for purposes of illustration and description. Further, the description is not intended to limit the invention to the form disclosed herein. Consequently, variations and modifications commensurate with the above teachings, within the skill or knowledge of the relevant art, are within the scope of the present invention. The embodiments described hereinabove are further intended to explain the best mode presently known of practicing the invention and to enable others skilled in the art to utilize the invention in such or in other embodiments and with various modifications required by the particular application or use of the invention. It is intended that the appended claims be construed to include alternative embodiments to the extent permitted by the prior art.

What is claimed is:

1. A method for providing a user specific set of electronic audio device acoustic adjustment parameters, comprising:

obtaining a set of user specific acoustic adjustment parameters that are stored as a template in a server on a communication network;

associating the obtained set of user specific acoustic adjustment parameters with an identifier;

storing the set of user specific acoustic adjustment parameters and the associated identifier;

receiving a request to access the stored set of user specific acoustic adjustment parameters in connection with an electronic communication in which the user is involved, wherein the request includes the identifier; and applying the user specific acoustic adjustment parameters to the electronic communication thereby adjusting speech delivered during the electronic communication by the user's communication device to the user in a way that increases intelligibility of speech for the user.

2. The method of claim 1, wherein the set of user specific acoustic adjustment parameters are obtained through a speech intelligibility test administered by an audiologist.

3. The method of claim 1, wherein the communication network comprises a public network.

4. The method of claim 3, wherein the template is provided to an endpoint associated with the user and the electronic communication for application of the user specific acoustic adjustment parameters at the endpoint.

5. The method of claim 4, wherein the template is provided to the endpoint over an out of band channel.

6. The method of claim 5, wherein the template is provided to the endpoint prior to establishment of the electronic communication.

7. The method of claim 1, wherein on the communication network comprises an enterprise network.

8. The method of claim 7, wherein the template is provided to an endpoint associated with the user and with the enterprise network for application of the user specific adjustment parameters at the endpoint.

9. The method of claim 8, wherein the template is provided to the endpoint over an out of band channel prior to the establishment of the electronic communication.

10. The method of claim 1, wherein a first set of acoustic adjustment parameters are applied to a first portion of the electronic communication, and wherein a second set of acoustic adjustment parameters are applied to a second portion of the electronic communication.

11. The method of claim 7, wherein the user specific adjustment parameters are applied to the electronic communication by the communication server.

12. The method of claim 7, wherein the user specific adjustment parameters are applied with respect to audio signals provided to the endpoint for output to the user.

13. The method of claim 12, wherein the user specific adjustment parameters are not applied with respect to audio signals provided to any other endpoint included in the electronic communication.

14. A system for improving the intelligibility of reproduced speech, comprising:

a server, including:

a processor;

data storage;

at least a first template stored in the data storage, wherein the first template includes acoustic adjustment parameters applicable to a first user;

a communication interface that connects the server to a communication network; and application programming stored in the data storage and executed by the processor, wherein the application programming is operable to:

in response to receiving a request to access the first template, at least one of:

apply the acoustic adjustment parameters included in the first template to a first communication over the communication network on behalf of the first user, wherein the first communication is provided to the server through the communication interface; or deliver the acoustic adjustment parameters to a first user device connected to the server via the communication network and through the communication interface for application by at least one of the first user device and another server.

15. The system of claim 14, wherein the server is a communication server associated with an enterprise, and wherein in response to receiving the request to access the at least a first template the application programming is operable to apply the acoustic adjustment parameters included in the first template to a first communication on behalf of the first user.

16. The system of claim 15, further comprising:

a first communication device, wherein the acoustic adjustment parameters included in the first template are applied on behalf of the first user to the first communication through the first communication device;

a second communication device, wherein the acoustic adjustment parameters included in the first template are applied on behalf of the first user to a second communication through the second communication device.

17. The system of claim 14, further comprising:

a first communication device, wherein the acoustic adjustment parameters included in the first template are delivered to the first user device for application by the first user device, and wherein the acoustic adjustment parameters are delivered to the first user device over an out of band channel.

18. A non-transitory computer readable medium having stored thereon computer executable instructions, the computer executable instructions causing a processor to execute a method for providing user specific acoustic adjustment parameters, the computer readable instructions comprising:

instructions to store a plurality of templates of acoustic adjustment parameters, wherein each of the templates in the plurality of templates is associated with a user;

instructions to identify a first template for application to a first electronic communication on behalf of a first user participating in the first electronic communication, wherein the first user is associated with the first template;

instructions to at least one of:

provide the first template from the plurality of templates to a first user device or to a communication server, or to apply the acoustic adjustment parameters to the first electronic communication.

19. The non-transitory computer readable medium of claim 18, wherein the instructions to identify the first template include instructions to at least one of:

recognize an identifier of the first template provided in connection with the first electronic communication, or identify the first user associated with the first template from presence information.

20. The non-transitory computer readable medium of claim 18, further comprising:

instructions to identify characteristics of a communication channel associated with the first electronic communication and to modify the acoustic adjustment parameters of the first template based on the identified characteristics of the communication channel.

* * * * *